United States Patent [19]

Ackert et al.

[11] Patent Number: 4,758,191

[45] Date of Patent: Jul. 19, 1988

[54] WATER SKI BINDING

[75] Inventors: Gail M. Ackert, Bothell; Donald B. Gillis, Lake Stevens; Patrick J. Connelly, Freeland, all of Wash.

[73] Assignee: Connelly Skis, Inc., Lynnwood, Wash.

[21] Appl. No.: 911,489

[22] Filed: Sep. 24, 1986

Related U.S. Application Data

[63] Continuation-in-part of Ser. No. 832,455, Feb. 21, 1986, Pat. No. 4,738,646.

[51] Int. Cl.[4] ..... A63C 5/00

[52] U.S. Cl. ..... 441/70; 24/134 R; 24/170

[58] Field of Search ..... 441/70, 68; 24/134 R, 24/170, 191, 193; 280/11.3, 611, 619

[56] References Cited

U.S. PATENT DOCUMENTS

| | | | |
|---|---|---|---|
| 2,165,547 | 7/1939 | Hill | 441/70 |
| 2,933,741 | 4/1960 | Walter | 441/70 |
| 3,143,750 | 8/1964 | Kluge | 441/70 |
| 3,360,812 | 1/1968 | Kluge | 441/70 |
| 4,389,200 | 6/1983 | O'Brien | 441/70 |

FOREIGN PATENT DOCUMENTS 65793 3/1956 France .

*Primary Examiner*—Sherman D. Basinger
*Assistant Examiner*—Edwin L. Swinehart
*Attorney, Agent, or Firm*—Christensen, O'Connor, Johnson & Kindness

[57] ABSTRACT

An adjustable water ski binding (10) is composed of an upper (18) secured substantially vertically between a laterally supportive, generally U-shaped internal frame (34) and a similarly shaped external frame (50) to form a foot-receiving binding cavity (22). A full length soleplate (24) underlies the internal frame (34) and includes a slot (108), allowing the width of soleplate (24) to be adjusted. A pair of rotation tabs (114) are secured to external frame (50) and include a plurality of adjustment holes (120) that allow tabs (114) to be additionally secured to a mounting plate (12). By selecting the proper pair of adjustment holes (120), the width of binding upper (18) can be increased or decreased. A pair of oppositely disposed strap portions (86), provided on binding upper (18), extend forwardly, overlapping the instep of binding upper (18). End portions (126) of straps (86) are adjustably securable between the internal frame (34) and external frame (50) to selectively vary the size of binding cavity (22).

17 Claims, 9 Drawing Sheets

WATER SKI BINDING

CROSS REFERENCE TO RELATED APPLICATION

The present application is a continuation-in-part of U.S. patent application, Ser. No. 832,455, filed Feb. 21, 1986, now U.S. Pat. No. 4,738,646 issued Apr. 19, 1988.

TECHNICAL FIELD

The present invention relates to bindings for water skis, and, more particularly, to a binding having a frame that is adjustable in width and provides lateral support to the skier's foot and having an upper that is laterally flexible. The binding frame cooperates with strap portions on the binding upper for further adjustment of the binding to accommodate various skier foot sizes.

BACKGROUND OF THE INVENTION

Well designed water ski bindings should not only fit well, but also properly support the skier's foot and ankle. Proper support is a function of good fit and offers the skier maximum control over the ski, while placing a minimum of stress on the skier's foot and ankle. A good binding fit also enhances the skier's safety in that with greater control over the ski, the skier is less likely to sustain an injurious fall. In addition to proper support and good fit, it is desirable to provide a binding upper that is comfortable to the skier. Also, because of the strains exerted on the binding when skiing, it is necessary that the binding be of rugged construction.

To provide proper support, known bindings for water skis typically include a binding upper consisting of a toe- or forward piece that extends tranversely over the forward portion of the foot and a heel- or rearward piece to cup the heel and ankle of the skier. The lower perimeter flange portions of the toepiece and heelpiece extend horizontally from their respective upper portions for securement horizontally to a mounting surface provided on the ski. Examples of this type of water ski binding are disclosed in U.S. Pat. Nos. 3,121,891 and 4,522,603. While such configurations generally provide enough lateral binding support to allow the skier to control the ski for precision turns, they do so at the expense of binding comfort. In such configurations, the lower perimeter flange portion of the toe- and heelpieces are generally horizontally clamped to the ski, while the majority of the upper portions of the toe- and heelpieces have a more vertical disposition capable of supporting the foot and ankle. Generally, this is achieved by a transitional portion of the binding that undergoes an arcuate, 90 degree upward bend from the flange to the upper portions of the toe- and heelpiece. The resultant inwardly concave portion of the binding upper is relatively stiff and unyielding, thereby resisting outward flexure. Thus, while the skier's foot is laterally supported, the comfort of the binding is significantly impaired.

Water ski bindings also have been designed to provide a direct vertical attachment between the binding upper and the soleplate of the binding. This configuration eliminates the relatively stiff arcuate juncture between the horizontal flange portions and vertical upper portions of previous water ski bindings, resulting in a binding that is more uniformly flexible throughout. An example of this type of binding is shown in U.S. Pat. No. 4,389,200. While this configuration may enhance the comfort of the water ski binding, it provides minimal lateral support to the skier's foot, thereby severely reducing the skier's control over the ski and seriously decreasing skier safety.

Perhaps the surest way of obtaining a properly fitting binding is to have one custom designed and made for an individual. However, such bindings are both expensive and limited to usage by one individual. Therefore, it is desirable that water ski bindings are constructed to accommodate a variety of skier foot sizes. In this regard the length of the water ski binding is commonly adjustable by use of a longitudinally slidable heelpiece. Use of a sliding heelpiece in conjunction with a forwardly narrowing open toepiece also provides some adjustment for width. Wider feet are simply retained farther back in the binding toepiece, with the heelpiece adjusted accordingly, while narrower feet are positioned farther forward in the binding toepiece. An example of a water ski binding constructed in this manner is shown in U.S. Pat. No. 3,089,158. These adjustable bindings, however, employ a spacing in the binding upper between the toepiece and the heelpiece to allow relative displacement of the two. Because major portions of the skier's foot and ankle are left uncovered by the binding in this configuration, less then optimum support or comfort results.

Other adjustable binding designs employ binding pieces that are movable in relation to a mounting plate by way of bolts that reside in slots located in either the binding pieces or the mounting plate. Such an arrangement can be used to adjust the length of the binding, or the binding width at the toe or heel. Examples of water ski bindings constructed in this manner are disclosed in U.S. Pat. Nos. 2,142,727 and 2,165,547. These designs also leave reduced regions of the skier's foot covered by the binding, thereby providing variably adjustable bindings at the expense of foot and ankle support and comfort.

Some water ski bindings also include a means for adjusting the binding fit by varying the instep of the binding. For example, the toepiece may be laced as disclosed in U.S. Pat. No. 2,165,547. Similarly, the toepiece may be stretched downwardly and rearwardly to reduce the size of the binding cavity adjacent the skier's instep, as disclosed in U.S. Pat. No. 3,143,750. Another possible option is to adjust the effective surface area of the toepiece while maintaining the same points of attachment on the soleplate. As disclosed in U.S. Pat. No. 2,933,741, one side of the toepiece can be secured by an eccentric clasp, allowing that end of the toepiece to be clamped at different points, thereby adjusting the binding toepiece to accommodate different skier's feet.

While each of these different binding configurations is capable of varying the instep region of the binding, none provides maximum coverage of, and hence support to, the skier's foot and ankle. In addition, because the toepiece is generally angled forwardly downward, the reduction in the binding instep produces a rearward component of force on the skier's foot which must be resisted entirely by the heelpiece. None of these configurations discloses an integral means for counterbalancing this rearward force on the skier's foot.

Because the toe and heelpieces typically are subject to considerable flexure during usage, the durability of the binding often suffers. Similarly, the binding may employ a number of moving parts that can wear and, ultimately, fail. In addition, holes are frequently formed in the lower perimeter portion of the binding upper, which is clamped to the mounting surface of the ski by a frame provided with bolts that pass through the holes, anchoring the binding. The force exerted by the binding upper to hold the skier's foot in place is also experienced by the lower perimeter flange portion of the binding, resulting in frequent failures around the screw holes. To counteract these problems, stiffer, tougher binding upper material can be used. As noted earlier, however, this results in a decrease in the comfort experienced by the skier when wearing the binding. In addition, ribbed interfaces between the lower perimeter flange portion of the binding upper and the frame have been employed, as have lower perimeter portions that are harder and less resilient than the remainder of the binding upper. While each of these approaches reduces the tendency of the binding to tear when holes are provided, neither has proved totally successful.

Accordingly, it is a principal object of the present invention to provide a water ski binding that laterally supports the skier's foot and ankle and provides an adjustable fit, while maintaining a generally resilient binding upper that is both comfortable to wear and of rugged construction.

A particular object of the present invention is to provide a frame assembly for the binding that forms a laterally supportive depression for the skier's foot and secures the binding upper to extend upwardly and inwardly therefrom, thereby producing a comfortable laterally flexible binding that also offers the skier maximum control over the ski.

A further particular object of the present invention is to provide a frame assembly for the binding that is variable in width for preferred use in conjunction with a binding upper having an adjustable instep, the resultant adjustable binding producing the optimum fit to the feet of a large number of skiers while providing maximum support of the skier's feet and ankles.

SUMMARY OF THE INVENTION

The foregoing and other objects are achieved in accordance with the present invention by securing a binding upper to extend upwardly and inwardly from a frame assembly having an internal frame including a pair of spaced, longitudinally extending abutment ridges defining a depression that laterally supports substantially the full lengths of the sides of the skier's foot. The frame assembly may be variable in width, allowing the size of the binding to be adjusted. The binding additionally may be adjustable at the instep by way of forwardly extending and laterally overlapping strap portions provided on the binding upper and secured in relation to the internal frame.

According to particular aspects of the present invention, the frame assembly also includes an external frame provided to secure a lower perimeter portion of the binding upper to the internal frame in upwardly and inwardly sloped disposition. Further, the internal frame is secured to a full length soleplate having a longitudinal slot that opens at the toe. A spreader bar is engageable with the slot to selectively vary the width of the slot and thus the soleplate thereby varying the width of the binding. A pair of tabs are rotatably mounted on pintles secured to the forward portions of the frame assembly. The tabs include a plurality of spaced-apart adjustment holes located at varying distances from the pintle for selective engagement with a pair of fasteners disposed at fixed locations on the surface to which the binding is mounted. By selecting the proper adjustment holes for engagement with the fasteners, a variety of binding widths are obtainable.

In another aspect of the present invention, the binding upper consists of a separate toepiece and heelpiece, each having a lower perimeter portion that extends upwardly and inwardly from the frame assembly substantially along the entire length of the frame assembly. The heelpiece includes a pair of oppositely disposed strap portions that extend forwardly along the binding upper and then laterally across each other in overlapping configuration to be secured between the toepiece and the external frame.

According to a more detailed aspect of the present invention, the strap portions of the heel wrap may be secured to the frame assembly in various fashions. In one design, the ends of the strap portions are provided with a plurality of ribs for selective engagement with a plurality of longitudinal slots provided in side portions of the frame assembly. Alternatively, the ends of the strap portions may be provided with a plurality of spaced-apart holes for engagement with a pin extending upwardly through the side portion of the frame assembly. The particular attachment locations of the strap portions to the frame assembly control the size of the binding instep.

In a further alternative, the ends of the strap portions of the heel wrap are secured to the frame assembly with a clasp assembly which receives the strap ends and automatically cinches the straps at a desired location therealong. The clasp assembly includes a friction cam and a clamping surface which together define a gap through which the strap end is inserted. The cam is pivotably mounted relative to the clamping surface so that as the strap end is pulled through the clasp assembly in a direction to tighten the binding upper, the cam is automatically pivoted in the direction away from the stop, thereby permitting the strap end to slide through the clasp assembly. However, when the pull on the strap end is terminated so that the stretched strap seeks to retract through the clasp assembly, the friction force between the strap and the cam causes the cam to pivot toward the stop, thereby tightly pinching the strap against the clamping surface. This prevents withdrawal of the strap end relative to the clasp assembly.

According to a further detailed aspect of the present invention, the instep portion of the toepiece that extends over and covers the instep of a skier's foot (and also underlies the criss-crossing strap portions) is constructed to be more resilient than the remainder of the instep portion, thereby to permit the width of the instep portion to readily expand and contract to accommodate different width feet. In one preferred aspect of the present invention, the top central section of the instep portion is formed of a reduced thickness relative to the remainder of the instep portion. In another preferred aspect of the present invention, a longitudinal slit extends along the top central section of the instep portion.

BRIEF DESCRIPTION OF THE DRAWINGS

The details of a typical embodiment of the present invention will be described in connection with the accompanying drawings, in which.

DETAILED DESCRIPTION OF THE INVENTION

Figure 1:
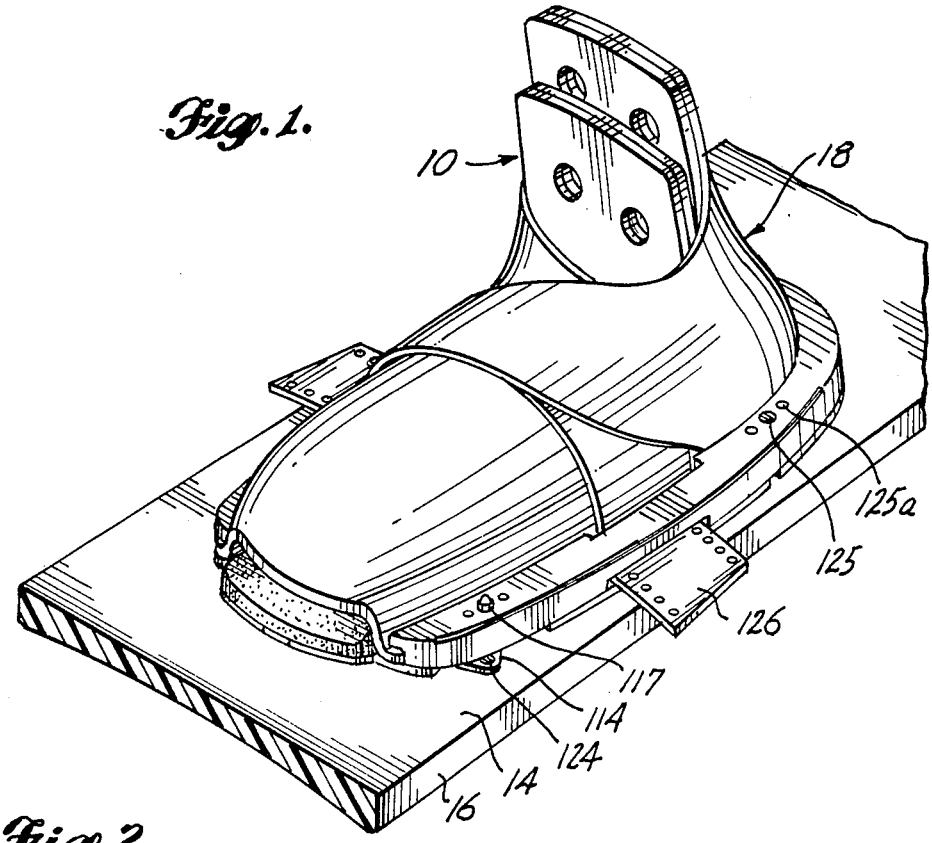
FIG. 1 is an isometric view of a water ski binding constructed according to the present invention and mounted on a water ski, as viewed from the forward and left side of the binding.

FIG. 1 illustrates a water ski binding 10 constructed according to the best mode of the present invention currently known to applicant as secured on the top surface 14 of a water ski 16. Water ski binding 10 in basic construction includes an adjustable, elastic binding upper 18 secured to a frame assembly 20 which in turn may be mounted on ski 16. Adjustable binding upper 18, in cooperation with frame assembly 20, defines a binding cavity 22 for adjustably receiving and restraining the foot, ankle, and lower leg of different skiers.

Figure 2:
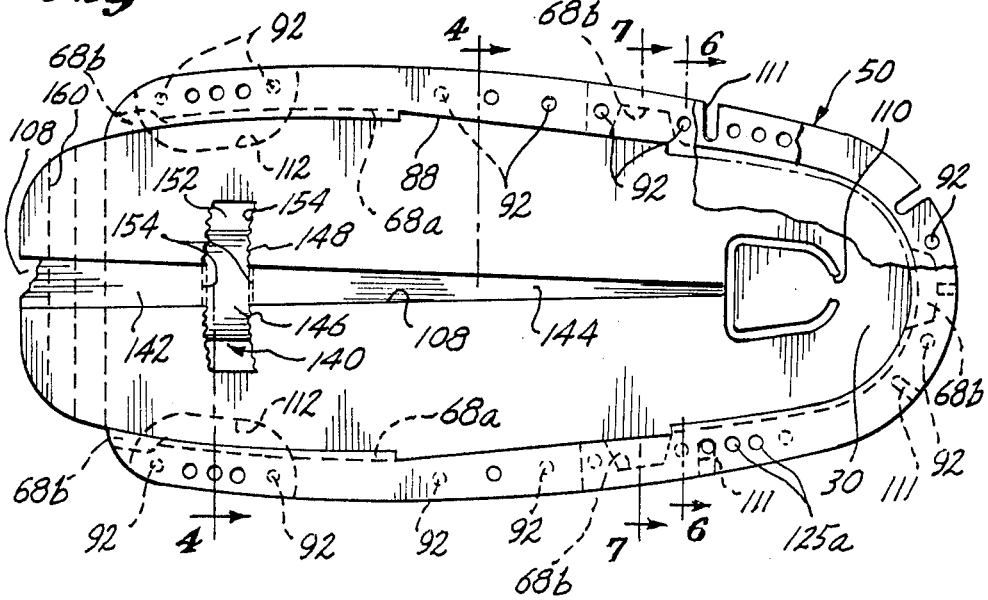
FIG. 2 is a plan view of the frame assembly with portions broken away for clarity.
Figure 3:
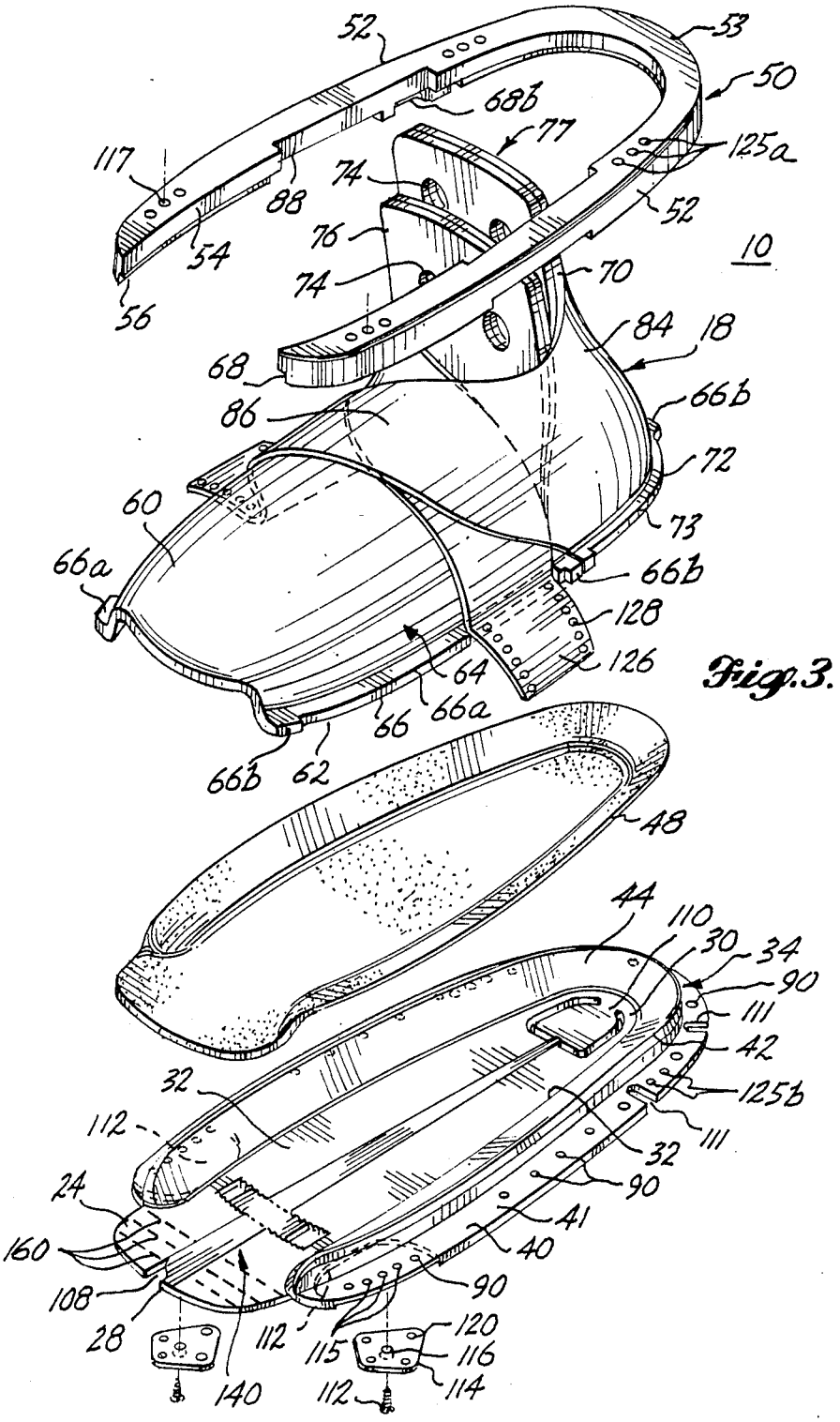
FIG. 3 is an exploded, isometric view of the present invention as viewed from substantially the same direction as FIG. 1.

Describing water ski binding 10 in more detail, and with additional reference to FIGS. 2 and 3, frame assembly 20 consists of three primary components. A very thin, flat, elongate soleplate 24 has a bottom mounting surface in contact with the top surface 14 of ski 16. Soleplate 24 additionally has a forward toe end 28, a rear heel end 30, and side portions 32. A generally U-shaped internal frame 34 extends around the sides 32 and rear heel end 30 of soleplate 24 and extends upwardly of the top surface 36 of the soleplate. Internal frame 34 is formed with an outward flange portion 40 extending along and outwardly of the internal frame to define a top, horizontal clamping surface 41. Internal frame 34 also includes an inward abutment ridge 42 defined by a concave, inwardly disposed support surface 44 and an outwardly disposed, sloping surface 46. Support surface 44 of internal frame 34 in cooperation with the top surface 36 of soleplate 24 defines a supportive depression 47 (FIGS. 4, 6 and 7) that provides lateral support to the sole of the skier's foot positioned in the binding 10. A footpad 48 covers the supportive depression for comfort. Although footpad 48 can be constructed from a wide variety of materials, for durability and comfort it is preferably composed of neoprene sponge material having a hardness of about 10 to 25 durometer.

A generally U-shaped external frame 50 is formed with opposite side portions 52 interconnected by a curved rear end portion 53 to correspond with the shape of internal frame 34. External frame 50 includes an inwardly disposed, upwardly and inwardly sloped surface 54, and a generally horizontal, bottom clamping surface 56 positioned above the top surface 41 of flange portion 40 of the internal frame 34. The space or gap between the sloped surfaces 46 and 54 of internal frame 34 and external frame 50, respectively, along with the space between portions of the clamping surfaces 41 and 56, is intended for reception of a lower perimeter portion of the binding upper 18.

Soleplate 24 preferably is fabricated from a sturdy, lightweight, thin material capable of adding rigidity to the assembled binding 10. For example, sheet aluminum of up to approximately one-sixteenth inch (0.040 cm) thick or a relatively rigid, hard, durable plastic material, such as nylon, up to about 0.080 inch thick is deemed suitable. Internal frame 34 and external frame 50 preferably also are molded from a relatively hard, durable plastic capable of withstanding flexure when the width of water ski binding 10 is adjusted. For example, the use of nylon with or without a reinforcing material, such as fiberglass, has been found suitable. Internal frame 34 can be bonded to soleplate 24 with a suitable well-known, commercially-available agent, such as an adhesive or epoxy cement. External frame 50, on the other hand, preferably is secured to the flange portion 40 of internal frame 34 by suitable fasteners 94 described in greater detail below.

Preferably, soleplate 24 is integrally constructed or molded with internal frame 34 to form a single unit as illustrated in FIGS. 2, 3, 4, 6 and 7. Although various types of materials may be employed to construct the integral soleplate/internal frame unit, preferably a relatively rigid, high-strength, durable plastic, such as nylon, is employed so that the unit can be economically molded while having sufficient structural integrity to safely support the skier's foot. Ideally the underside of the integral soleplate/internal frame unit is formed with a relief slot 59 of generally triangular cross section that is disposed beneath and extends along abutment ridge 42. Through the use of relief slots 59, the wall sections composing the integral soleplate/internal frame unit are generally uniform to facilitate the molding of the unit, while minimizing stress risers due to large variations in the wall sections.

In accordance with the present invention, soleplate 24 and footpad 48 are constructed as thin as possible so that the bottom of the skier's foot is as close to the top surface 14 of the ski 16 as possible. As will be appreciated the closer the bottom of the foot is to the top of the ski, the greater the ability to control the ski. To this end preferably, footpad 48 is made from neoprene sponge or similar material having a durometer of from about 10 to 25 and a thickness of from about 0.125 inch (0.3175 cm) up to about 0.25 inch (0.635 cm) thick. Applicants have found that by this construction, the pad is resilient enough for proper foot comfort but thin enough to enhance the skier's control over the ski. If soleplate 24 is made from 0.080 inch thick plastic material and footpad 48 is made from 0.25 inch thick neoprene sponge material, due to the resilience of the footpad, the bottom of the skier's foot advantageously will be at most about 0.30 inch above the top surface 14 of ski 16.

Figures 4, 5, 6, 7, 8:
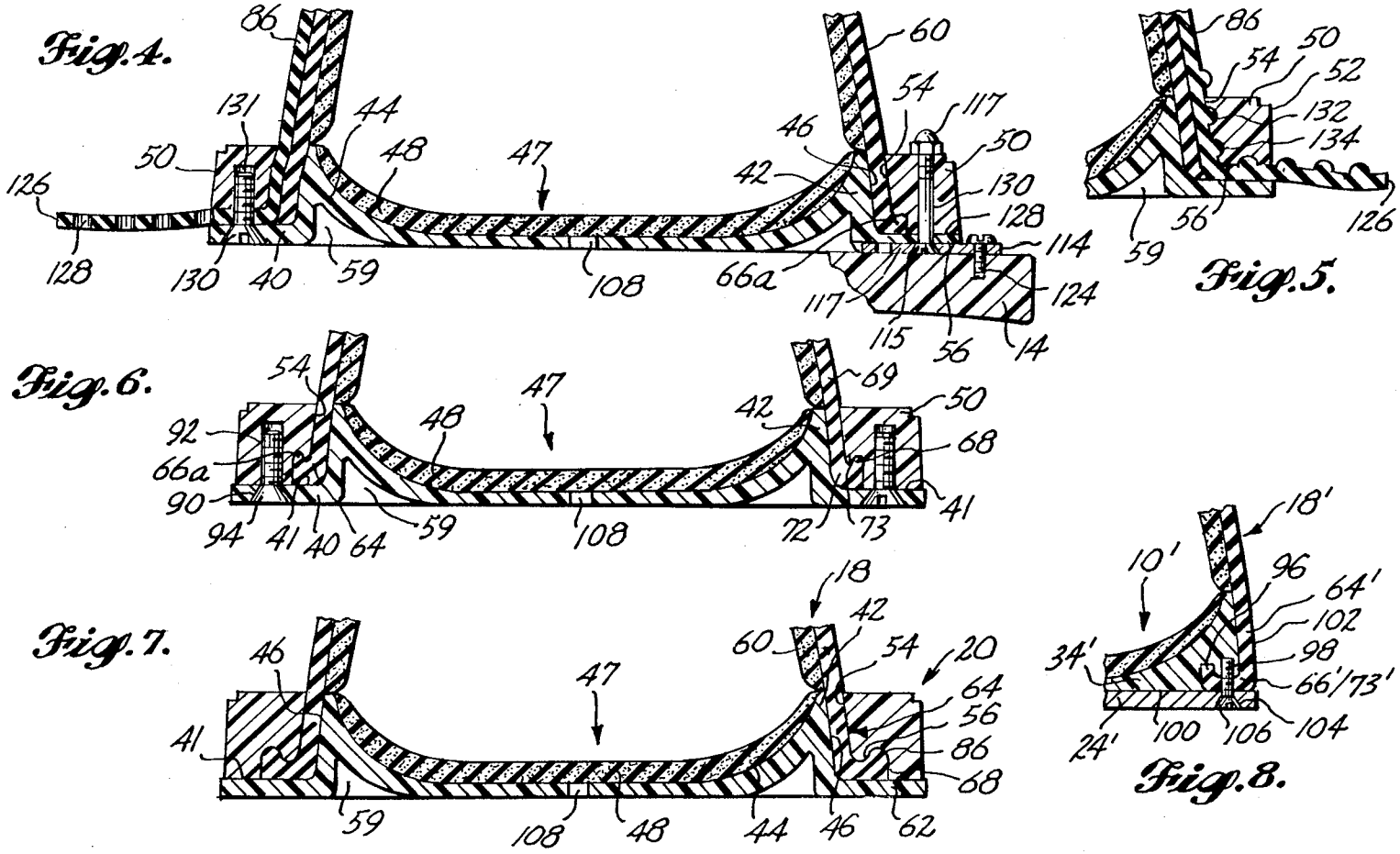
FIG. 4 is an enlarged, fragmentary, cross-sectional view of the binding assembly shown in FIG. 1, taken substantially along the section lines 4—4 of FIG. 2.
FIG. 5 is a view similar to a portion of FIG. 4, but illustrating an alternate preferred method of securing the strap portions of the binding upper to the frame assembly.
FIG. 6 is an enlarged, fragmentary, cross-sectional view of the binding assembly shown in FIG. 1, taken substantially along section lines 6—6 of FIG. 2.
FIG. 7 is an enlarged, fragmentary cross-sectional view of the binding assembly shown in FIG. 1, taken substantially along section lines 7—7 of FIG. 2.
FIG. 8 is an enlarged fragmentary, cross-sectional view, similar to that of FIG. 7, of another preferred embodiment of the present invention that does not employ an external frame.

Binding upper 18 consists of two major components; toepiece 60 and a heelpiece 69. Although the toepiece is illustrated as being forwardly open it can alternatively be closed. The generally resilient toepiece 60 is formed with lower perimeter side portions 64 that define outwardly and horizontally extending, variable width, side flanges 62. Ridges 66, having narrower sections **66*a* and wider sections 66*b*, extend along and upwardly from side flanges 62. With the lower perimeter side portions 64 of toepiece 60 positioned between the internal frame 34 and the external frame 50, toepiece 60 extends upwardly and inwardly from the frame assembly 20 to define an arcuate roof for the region of binding cavity 22 supporting the toes and the instep of the skier. As shown in FIGS. 4 and 7, toepiece 60 constitutes a substantially uninterrupted, arcuate continuation of supportive depression 47** thereby conforming to the shape of the skier's foot while also providing maximum resiliency and, therefore, skier comfort.

With the binding 10 assembled, toepiece ridges 66 cooperatively engage slots 68, having narrower sections **68*a* and wider sections 66*b* corresponding to toepiece ridge portions 66*a* and 66*b*, respectively. Slots 68 extend longitudinally along the intersection of the sloped surface 54 and bottom clamping surface 56 of external frame 50. Thus, ridges 66 allow toepiece 60 to remain securely in place even when subject to the rigorous forces exerted upon the binding 10 during skiing. The wider slot sections 68*b*, as shown in FIG. 2, are located at positions of higher stress placed on the foot during skiing, i.e., at the front of toepiece 60, at the intersection of toepiece 60 and heelpiece 69 (at the sides of binding 10**) and at the rear of the heelpiece.

The heelpiece 69 includes a heelcup 70 which is also preferably formed from resilient material and has a lower perimeter portion 71 defining a continuous horizontal outwardly extending flange 72 closely approximating flange 62 of toepiece 60 and secured between horizontal clamping surfaces 41 and 56. As with the toepiece 60, heelcup 70 has a variable width ridge 73 extending upwardly from and along flange 72, which is of corresponding variable width. As previously described in conjunction with the discussion of toepiece 60, ridge 73 cooperatively engages the variable width slot 68 formed in the external frame 50, thereby enhancing the connection of heelpiece 69 to frame assembly 20.

As with toepiece 60, heelpiece 69 extends upwardly and inwardly from frame assembly 20, to conform to the shape of the skier's foot while retaining the flexibility of heelpiece 69 and, hence, enhancing the comfort of binding 10. The lateral support provided by the abutment ridge 42 of internal frame 34, however, allows the skier to maintain precise control over the water ski 16 without sacrificing this flexibility.

Heelcup 70 is formed such that, with the continuous, variable width flange 72 of the heelcup secured between clamping surfaces 41 and 56, the rear portion of binding cavity 22, supporting the skier's heel and ankle, is defined upwardly in the longitudinal forward direction in line with a skier's lower leg when bent at the knee. Thus, the skier's ankle and foot are held by the binding 10 in the desired position for skiing. Because toepiece 60 slopes upward in the longitudinal rearward direction while heelcup 70 tapers upward in a forward direction, the toepiece 60 and heelpiece 70 direct longitudinally opposing forces upon the skier's foot, providing further support.

Heelpiece 69 also includes a pair of oppositely disposed strap portions 86 that are preferably integrally constructed with heelcup 70. Strap portions 86 extend forwardly of heelcup 70 and laterally across toepiece 60 in overlapping configuration, passing between the side portions 64 of the toepiece 60 and the sloping surface 54 of external frame 50, FIGS. 3 and 4. To accommodate the additional thickness of material at this point, recesses 88 are provided in the sides 52 of external frame 50.

To provide maximum comfort and support, toepiece 60 and heelpiece 69 preferably are composed of composite material, having a plurality of layers serving different functions. Ideally they include an inner layer of soft, foam rubber to cushion the skier's foot. The surface of the inner layer may also be gridded with slight protrusions of foam rubber to provide further cushion and less surface adhesion to the foot when inserted in, and removed from, the binding. A second, stiffer outer layer of rubber is employed to provide the necessary support for the skier's foot and ankle. A greater number of layers can be used to provide the level of comfort, strength, flexibility and other characteristics desired. For additional convenience in donning and doffing the binding 10, a pair of fingerholes 74 are provided on the rear, uppermost regions 76 and 77 of toepiece 60 and heelpiece 69. Fingerholes 74 allow the skier to obtain a firm grip on the potentially slippery regions 76 and 77 and stretch the binding 10 to ease insertion and removal of the foot from binding cavity 22.

In the currently preferred embodiment of the invention, toepiece 60 and heelpiece 69 are molded by a process similar to that disclosed in U.S. Pat. No. 4,522,603. Thus, an integral piece may be formed having an inner surface composed of, for instance, 0.25 inch (0.635 cm) thick textured neoprene foam or similar material having a durometer of about 8 to 10. Similarly, the outer surface may consist of, for instance, from 0.125 inch (0.3175 cm) to 0.375 inch (0.925 cm) thick neoprene or similar material having a durometer of about 50.

As noted previously, the flanges 62 and 72 of the lower perimeter portions 64 and 71 of toepiece 60 and heelpiece 69 are securely positioned between the horizontal clamping surfaces 41 and 56 of the internal frame 34 and external frame 50, respectively. To accomplish this, a plurality of beveled clearance holes 90 are located in flange portion 40 of internal frame 34. One plurality of oppositely disposed holes 90 is arranged near the forward or toe ends of flange 40 and additional holes 90 are arranged along the length of flange 40. The external frame 50 is provided with holes 92 aligned with the corresponding clearance holes 90 in flange 40 when external frame 50 is positioned thereon. The external frame holes 92 are threaded for engagement with screws 94 extending upwardly through clearance holes 90 in flange 40. When screws 94 are tightened, the flange portions 62 and 72 of binding upper 18 are securely clamped between the internal frame 34 and the external frame 50. It should be noted, as shown in FIG. 6, that this arrangement allows binding upper 18 to be secured to frame assembly 20 without necessitating the use of holes in the upright wall sections of the lower perimeter portions 64 and 71, which could result in reduced strength and eventual failure of binding upper 18.

While ridges **66*a*, 66*b* and 73 of the toepiece 60 and heelpiece 69 may be of uniform cross section, it has been found to be advantageous to vary their cross-sectional widths. This requires a corresponding variation in the cross-sectional width of portions of slots 68*a* and 68*b* provided in external frame 50. Along a majority of their lengths the cross-sectional widths of ridges 66*a*, 66*b* and 73 are uniform, as shown in FIG. 6. However, at the forward end of toepiece 60, at the intersection of the toepiece and heelpiece 69, and at the rear of the heelpiece, the widths of ridges 66 and 73 are widened to correspond with wider slot portions 68*b* formed in the external frame, e.g., as shown in FIG. 7. These wider portions of ridges 66*b* and 73 have been identified as being the highest stressed or loaded locations of the binding upper 18. It will be appreciated that the use of the widened ridge portions increases the clamping area of the ridge portions, thereby more securely attaching the lower perimeter portions 64 and 71 of the binding upper 18 to frame assembly 20**.

As an illustrative but nonlimiting example, the narrower portions of ridges **66*a* and 73 and the narrower slot portions 68*a* preferably may be approximately $\frac{1}{8}$ inch (0.32 cm) wide and the wider portions of ridges 66*b* and 73 and the wider slot portions 68*b* preferably may be approximately from $\frac{1}{4}$ inch (0.64 cm) to $\frac{3}{8}$ inch (0.96 cm) wide. Also, as an illustrative but nonlimiting example, the height of the ridge portions 66 and 73 and the depth of slot portions 68*a* and 68*b* preferably is approximately $\frac{3}{8}$ to $\frac{1}{4}$ inch (0.32 to 0.64 cm). To effect even greater holding power, ridges 66 and 73 may additionally increase in cross section as they continue away from the binding upper 18. FIG. 2** identifies the relative locations of these various ridge and slot arrangements in a currently preferred embodiment of the water ski binding.

As shown in FIG. 8, an alternate method of securing binding upper 18' to frame assembly 20' allows binding 10' to be constructed without the use of an external frame 50. In this configuration, ridges 66' and 73' are providing on the interior surface of the lower perimeter portions 64' and 71' of binding upper 18'. These ridges cooperate with an upwardly extending longitudinal slot 96 and a downwardly extending shoulder 98 provided in the bottom surface 100 of internal frame 34'. In addition, a plurality of upwardly extending, threaded holes 102 pass a portion of the way through internal frame 34' and are arranged for alignment with a plurality of aligned counterbored clearance holes 104 provided in soleplate 24'. Screws 106 extend upwardly through holes 104 into engagement with the threaded holes 102 provided in the internal frame 34'. Because the thickness of the lower perimeter portions 64' and 71' of binding upper 18' exceeds the distance separating the bottom of shoulder 98 and the top surface of soleplate 24', shoulder 98 and slot 96 of internal frame 34' securely clamp the lower perimeter portions 64' and 71' of binding upper 18' against the soleplate 24' when screws 106 are tightened. In this configuration, a flange, such as flange 40 of internal frame 34 is unnecessary.

To allow the water ski binding 10 to be used by more than one skier, without sacrificing fullness of support, a means for adjusting the width of the binding 10 and instep of binding cavity 22 is provided. To this end, soleplate 24 includes a tapered slot 108 extending substantially along the longitudinal central axis of soleplate 24 and open to the toe end 28. The width of slot 108 increases in the direction of the toe end 28 of the soleplate 24. By applying opposing forces to the sides 32 of soleplate 24, the slot 108 can be opened or closed, widening or narrowing the soleplate 24. Because slot 108 is widest at the toe end 28 of soleplate 24, the greatest width adjustment occurs at that end. The end of slot 108 closest to the heel end 30 of soleplate 24 is defined generally in the shape of a triangle having an arcuate apex that terminates at a narrow bridge portion 110. Constructing the end of the slot in this manner provides soleplate 24 with sufficient flexibility to be readily adjusted in width, as discussed more fullyh below. Also, forming the end of slot 108 in this manner distributes the stress induced by narrowing or widening the soleplate. Thus, failure of the soleplate 24 between the end of slot 108 and the heel end 30 of the soleplate is less likely than if slot 108 was simply formed with a V-shaped termination. To also facilitate the width adjustment of soleplate 24, a plurality of transverse notches 111 are formed in the rear or heel portion of flange 40 of the internal frame. As shown best in FIGS. 2 and 3, the notches are generally U-shaped and open in the outward direction.

An elongate, longitudinally tapering spreader bar 140 is provided to occupy slot 108 and to nominally maintain soleplate 24 at the desired width, for instance during the assembly of binding 10 and also when the binding is removed from water ski 16 to adjust an width of the binding. To this end, spreader bar 140 is constructed with an elongated, tapered forward section 142 and an elongated, tapered rearward section 144 separated by a generally rectangularly shaped, intermediate section 146 extending transversely of the forward and rearward sections. The forward and rearward sections may occupy slot 108 thereby providing support for the underside of footpad 48. The margins of intermediate section 146 are formed with serrations 148 that mesh with corresponding serrations 150 formed in the margins of transverse notches 152 extending laterally from slot 108 to receive the intermediate section of the spreader bar. It will be appreciated that the width of soleplate 24 is determined by the placement of the serrations 148 of the spreader bar relative to the serrations 150 of the two notches 152 formed in the soleplate. As discussed more fully below, if it is desired to adjust soleplate 24 to a relatively narrow width, the forward and rearward sections 142 and **144*a* of the spreader bar may be detached from the intermediate section, thereby allowing slot 108** to be substantially closed.

Next, referring primarily to FIGS. 1, 3 and 4, internal frame 34 is formed with a pair of oppositely disposed recesses 112 directed inwardly from the side flanges 40. The recesses are located adjacent the forward toe ends of the flanges 40 and underlie the flanges. The recesses 112 are of sufficient dimension to accept thin, rotatable tabs 114 having a generally trapezoidal geometry. Tabs 114 are provided with center pivot holes 116 for cooperation with corresponding pintles 118 extending upwardly through clearance holes 115 in flanges 40 and corresponding clearance holes 117 in external frame 50 to engage with a threaded fastener, such as cap nut 119. Thus, each tab 114 rotates about a pintle 118. Tabs 114 also include a plurality of spaced-apart adjustment holes 120 that are located varying distances from the center pivot hole 116. Water ski 16 is provided with a pair of threaded holes spaced a fixed, selected distance from each other across the water ski. As tabs 114 are rotated, progressive adjustment holes 120 are disposed outwardly from external frame 50, making them accessible to screws 124 extending downwardly into ski 16.

Screws 124 serve to secure tabs 114 and, thus, the forward end of binding 10 to ski 16. The rearward end of binding 10 is secured to ski 16 by screws 125 which extend downwardly through one of the clearance holes 125*a* extending through external frame 50 and corresponding clearance holes 125*b* or notches 111 extending through side flanges 40 of internal frame 34 at opposite sides of the binding. As shown in FIGS. 1–3, the binding is formed with a plurality of flange clearance holes 115 and external frame clearance holes 117 for reception of pintles 118 and a plurality of clearance holes 125*a* and 125*b* for screws 125. This enables binding 10 to be positioned at various fore-and-aft locations relative to ski 16, thereby to alter the performance characteristics of the ski as desired.

By the above-described construction, it will be appreciated that soleplate 24 may be conveniently adjusted in width to accommodate various size feet, for instance, during the initial assembly of binding 10 or after the binding has been mounted on ski 16, in which instance the binding is removed from its ski by removal of screws 124 and 125 from the ski. In the adjustment procedure, the serrations 148 of the intermediate section 146 of spreader bar 140 are engaged at desired locations relative to serrations 150 of notches 152 to correspond with the desired width of soleplate 24. FIG. 2 illustrates a sufficiently wide adjustment wherein the forward and rearward sections 142 and 144 of the spreader bar are engageable within soleplate slot 108 to help support the underside of pad 48.

Figure 9A:
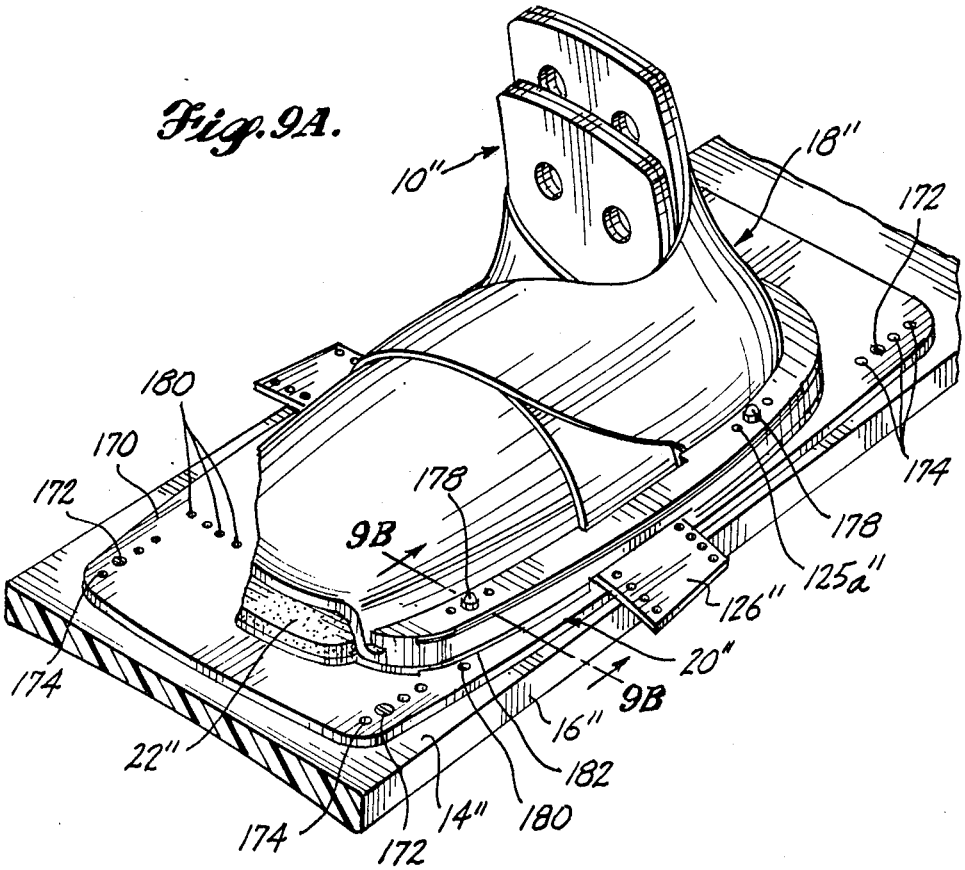
FIG. 9A is an isometric view similar to FIG. 1, but illustrating a binding as mounted on a mounting plate which in turn is mountable on a water ski.
Figure 9B:
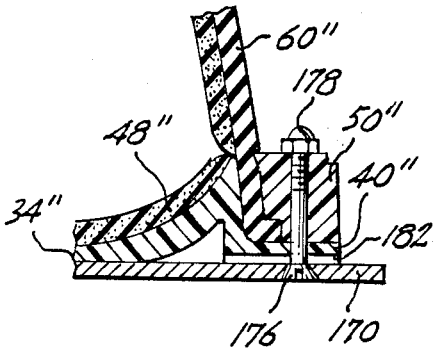
FIG. 9B is an enlarged, fragmentary, cross-sectional view of the binding assembly shown in FIG. 9A, taken substantially along lines 9B—9B thereof.
Figure 9:
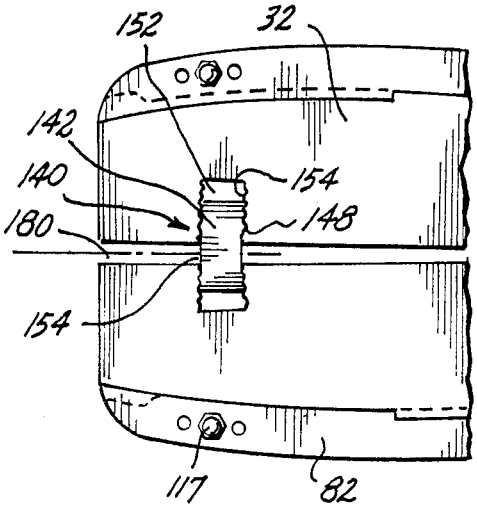
FIG. 9 is a plan view similar to FIG. 2, but with the binding adjusted to a narrower width and a shorter length.

FIG. 9 illustrates the soleplate adjusted to a narrower width. To accommodate this narrower width, the spreader bar is composed only of intermediate section 146, thereby to allow slot 108 to be substantially closed. To this end, the spreader bar can be initially constructed as composing only intermediate section 146 or the forward and rearward sections of the spreader bar can be detached from the intermediate section of the spreader bar. To this end, the spreader bar can be scored along lines extending across the spreader bar at the intersections of the forward and rearward sections with the intermediate section. Scoring the spreader bar in this manner enables the forward and rearward sections of the spreader bar to be conveniently broken off from the intermediate section.

Thereafter, tabs 114 are rotated about pintles 118 until a pair of adjustment holes 120 are aligned with the threaded holes provided in the water ski. It will be appreciated that the adjustment holes 120 are spaced relative to pintle 118 to correspond with the various widths to which the soleplates can be adjusted through the particular locations that spreader bar serrations 148 are engaged with serrations 150 of notches 150.

Although it is desirable to employ spreader bar 140, it will be appreciated that soleplate 124 may be adjusted to a desired width without the use of the spreader bar. To this end, tabs 114 can be rotated about pintle 118 until a desired pair of adjustment holes 120 are aligned with the threaded holes provided in the water ski. If the width of binding 10 is to be increased, a pair of adjustment holes 120 having a lesser spacing from the pivot holes 116 is selectively aligned with the threaded water ski holes prior to the reinsertion of screws 124 into the water ski. Conversely, if a narrow width binding is desired, a pair of adjustment holes having a greater spacing from center pivot holes 116 is selected.

While the tabs 114, so disclosed, are rotatable, it should be noted that any configuration of tabs 114, fixed or rotatable, having a plurality of spaced-apart adjustment holes 120 for cooperation with threaded holes in the water ski would be suitable. The particular embodiment shown in FIG. 3, however, provides an accessible means of adjusting the width of binding 10 while providing minimal disruption to the binding surface.

The length of binding 10 may also be adjusted as desired. As most clearly shown in FIG. 3, the toe end 28 of soleplate 24 is scored along one or more lines 160 extending transversely across the forward toe end. This enables the toe end to be broken off at a particular scored line as desired. As shown in FIG. 9, the entire toe end 28 may be detached from soleplate 24.

To further enhance the adjustable nature of the binding 10, a means for reducing the size of the binding cavity 22 adjacent the instep of the skier's foot is provided. Strap portions 86 of heelpiece 69 including end portions 126 detachably securable to frame assembly 20. Because straps 86 are laterally disposed in overlapping configuration across the portion of the binding upper 18 adjacent the skier's instep, changing the regions of the end portions 126 of straps 86 secured between the internal frame 34 and external frame 50 alters the size of the binding cavity 22 adjacent the skier's instep. Several means for variably adjusting the region of strap end portions 126 secured to the frame assembly 20 may be employed. As shown in FIGS. 1, 3 and 4, the end portions 126 of straps 86 may be provided with a plurality of hole pairs 128 that are aligned in opposing rows adjacent the edges of strap end portions 126. The hole pairs 128 of each end portion 126 cooperate with a pair of pins or screws 130, extending upwardly through flanges 40, through a hole pair 128 and into aligned, threaded blind holes 131 formed in external frame 50 adjacent the recesses 88.

To reduce the size of the binding cavity 22, pins 130 are retracted from a given hole pair 128 and the end portions 126 of the heel wrap straps 86 are pulled farther through the frame assembly 20. When the proper adjustment is reached, pins 130 are inserted through another hole pair 128 and into holes 131, securing the straps 86 in place.

In an alternative preferred embodiment shown in FIG. 5, end portions 126 of straps 86 are provided with a plurality of rounded ridges 132 extending substantially parallel to sides 52 of the external frame 50 when the binding 10 is assembled. The ridges 132 are intended for selective cooperative engagement with a plurality of slots 134, having a generally semicircular cross section, provided in the sloping side surface 54 and bottom clamping surface 56 of the external frame recesses 88.

To adjust the size of the binding cavity 22, screws 94 securing the external frame 50 to the flange portion 40 are loosened, and the end portions 126 of the heel wrap straps 86 drawn through the frame assembly until the desired size of binding cavity is obtained. At this time, screws 94 can be again tightened, securing the binding upper 18 to the frame assembly 20 as desired. It will be appreciated that ridge 132 can be of cross-sectional shapes other than shown in FIG. 5, such as triangular or V-shaped, without departing from the spirit or scope of the present invention. Also, binding 10 can be constructed with either or both the binding width and instep cavity adjustment provisions discussed above.

FIG. 9A illustrates a further alternative preferred embodiment of the present invention wherein binding 10″ is mounted on a mounting plate 170 which in turn is secured to water ski 16″. Preferably, plate 12 is constructed from lightweight, high-strength, corrosion resistant material such as aluminum or a hard, durable plastic. Mounting plate 170 is secured to ski 16″ by screws 172 extending downwardly through clearance holes 174 formed in the plate to engage with aligned threaded openings formed in the water ski. A series of longitudinally spaced-apart clearance holes 174 may be associated with each mounting screw 172 to permit the mounting plate 170 and, thus, also binding 10″, to be adjusted longitudinally relative to the ski.

As most clearly shown in FIG. 9B, binding 10″ is mounted to mounting plate 170 by screws 176 which extend upwardly through clearance holes provided in side flange portions 40″ and external frame 50″ to engage with cap nut 178. To adjust the width of binding 110, tabs 114 are not required, rather, as shown most clearly in FIG. 9B, screws 176 extend upwardly through one of a series of transversely spaced-apart clearance holes 180 formed in the mounting plate. As can be appreciated, the particular clearance hole 180 through which screw 176 extends upwardly through, determines the width of soleplate 24. Preferably, then spacers 182 are disposed within recesses 112 beneath internal frame flanges 40 (which provide clearance for tabs 114, FIG. 3) thereby to fill the recess so that a substantially uniform clamping load is applied to side flanges 40″ of inner frame 34″. Other than the foregoing variations, binding 10″ illustrated in FIGS. 9A and 9B ideally is constructed substantially the same as binding 10 illustrated in FIGS. 1–7 and 9.

Figure 11:
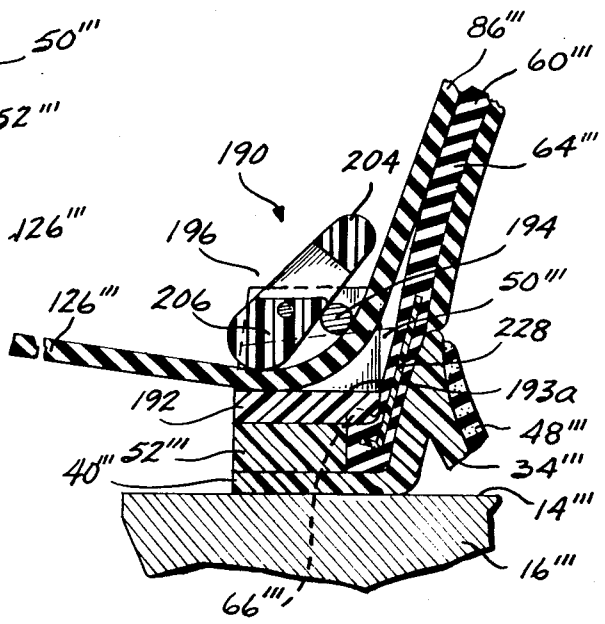
FIG. 11 is an enlarged, fragmentary, cross-sectional view, taken substantially along section lines 11—11 of FIG. 10 with the strap portions of the binding upper shown in preadjustment position.
Figure 10:
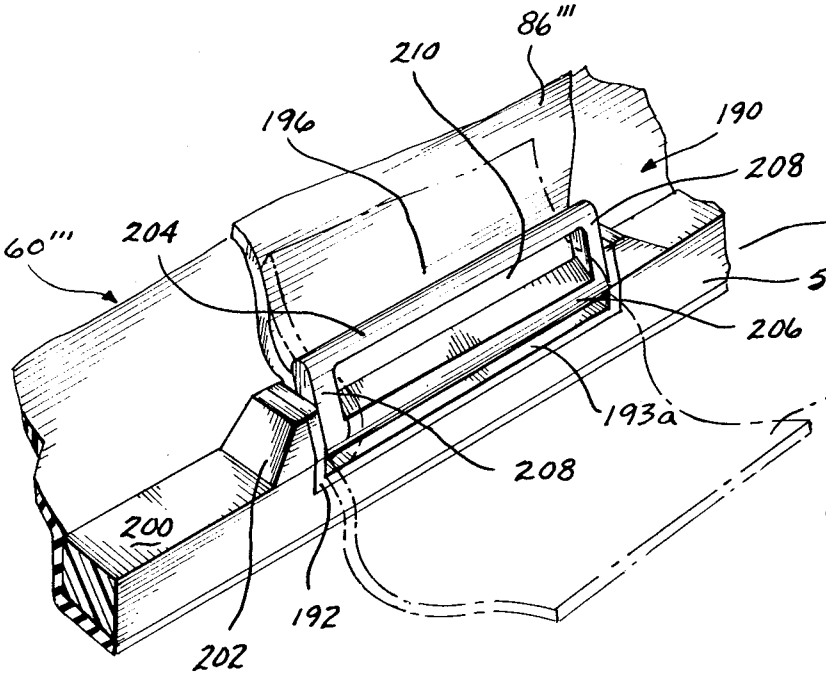
FIG. 10 is an enlarged, fragmentary, isometric view of a further preferred embodiment of the present invention illustrating another method of securing the strap portions of the binding upper to the frame assembly.
Figure 12:
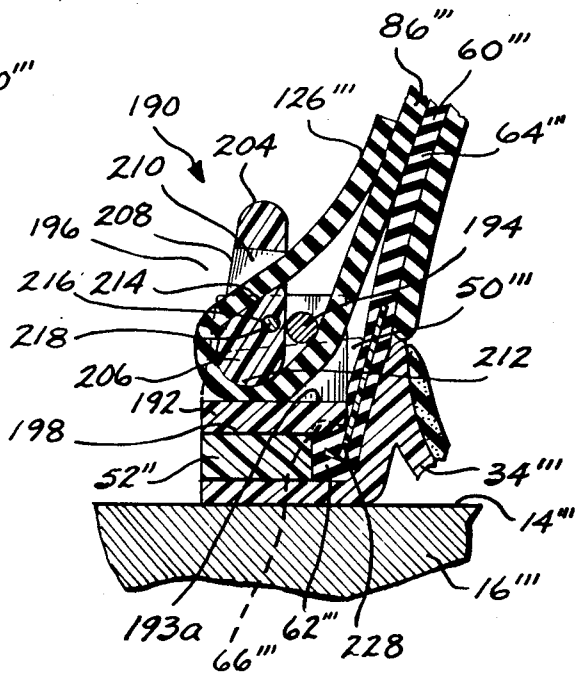
FIG. 12 is a fragmentary cross-sectional view similar to FIG. 11, but with the strap portions of the binding upper illustrated in adjusted position.

FIGS. 10, 11 and 12 illustrate another preferred manner of varying the size of binding cavity 22 by adjusting the lengths of strap portions 86‴ of heelpiece 69‴. This is accomplished with a clasp assembly 190 which automatically cinches the ends 126‴ of strap portions 86‴ to a binding external frame 50‴ at the desired location along the length of the strap ends. In basic form, the clasp assembly 190 is composed of a mounting bracket 192 secured to the side portions 52‴ of external frame 50‴ at the locations at which strap ends 126‴ cross the external frame side portions. The clasp assembly 190 also includes a friction cam 196 that is rotatably mounted on the bracket to define a gap between the cam and the bracket for receiving and releasably clamping or pinching strap end 126‴. A cam stop 194 extends alongside the friction cam at location between the friction cam and the adjacent portion of strap end 126‴.

Describing the construction and operation of the clasp assembly in more detail, as illustrated in FIGS. 10–12, mounting bracket 192 is generally U-shaped with an elongate, flat base section 193 extending longitudinally along external frame side portions 52‴ with the top **193*a* of the base section functioning as a clamping surface for cooperating with the cam 196 to releasably clamp strap end 126‴ therebetween. The base section 193 terminates at end sections 193*b* which extend upwardly from the ends of the base section. As shown most clearly in FIGS. 11 and 12, the widths of the base 193 and end sections 193*b* of bracket 192 generally correspond to the width of the side portions 52‴ of external frame 50‴ with the outward edge of the bracket 192 (left-hand side as shown in FIGS. 11 and 12) being substantially flush with the outward edge of frame side portions 52‴. Bracket 192 snugly engages within a close fitting recess 198 formed in external frame side portions 52‴. The bracket may be attached to the external frame by any convenient means, for instance, with a suitable adhesive or mechanical fastener. The end sections of bracket 192 extend upwardly above the top surface 200 of external frame side portions 52‴. To receive and provide support for the end sections 193*a* of bracket 192, the external frame side portions 52‴ are constructed with upwardly extending, beveled shoulders 202 that extend upwardly from top surface 200 to be flush with the top edges of bracket end sections 193*b*. Although bracket 192 has been illustrated and described as structurally separate from external frame 50‴, and discussed below with respect to FIG. 13**, it may be integrated into the construction of the external frame without departing from the spirit or scope of the present invention.

The friction cam 196 includes an elongate upper retainer section 204 which is disposed in spaced parallel relationship with a lower cam section 206 by end sections 208, thereby to define the gap or opening 210 between the retainer and cam sections. The retainer section, as most clearly illustrated in FIGS. 11 and 12, in cross section is substantially in the shape of a circle, but with a flattened lower surface adjacent cam section 206. The cam section is formed with an arcuate cam face or surface 212 which faces the top surface of the base section 193 of bracket 192 and flat side faces that are disposed tangentially to the cam face and retainer section 204. As most clearly shown in FIGS. 11 and 12, cam face 212 substantially defines the circumference of a circle having a diameter somewhat larger than the circle defined by retainer section 204. The cam section 206 also includes a sloped upper surface 214 which is inclined upwardly and in the inward direction relative to the binding, i.e., toward the right-hand side shown in FIGS. 11 and 12.

The friction cam 196 is mounted on the bracket 192 to pivot about an axis 218 by pivot pins 216 extending through aligned, close-fitting openings formed in the upstanding end sections of the bracket and in the ends of cam section 206. Pivot pins 216 support the friction cam so that the cam face 212 and the top surface **193*a* of bracket base section 193 define a variable width strap receiving and retaining gap therebetween with the width of the gap dependent on the orientation of the cam about the pivot pins 216. The pivot pins, as shown in FIGS. 11 and 12, are located a substantial distance above the center of curvature of cam face 212 and are offset relative to the width of cam section 206 towards stop 194 (i.e., in the right-hand direction in FIGS. 11 and 12) so that the pivot axis 218** is likewise so offset.

As also shown in FIGS. 11 and 12, the pivot axis 218 is located at an elevation slightly above the central axis of a circularly shaped stop 194.

The cam stop 194 is in the form of an elongate, solid bar that spans the length of bracket 192 and is securely engaged with or otherwise fixedly attached to the upstanding end sections of the bracket at locations offset from the transverse center of the bracket in the direction toward the exterior surface of toepiece 60''' (i.e., toward the right-hand side in FIGS. 11 and 12). At this location the cam stop is positioned between the side of cam 190 and the section of strap portion 86''' that approaches the clasp assembly. Although stop 194 is illustrated as being circular in cross section, it can be formed in other cross-sectional shapes without departing from the spirit or scope of the present invention. Moreover, stop 194 could be integrally formed with bracket 192 or if, as noted above, bracket 192 is integrally formed with external frame 50''', then stop 194 likewise can be integrally formed with the external frame.

By forming cam face 212 and locating pivot pin 216 relative to the cam face and the top clamping surface **193*a* of bracket 192 in the manner described above, with strap end 126''' disposed in the gap defined by cam face 212 and clamping surface 193*a*, when the cam 190 is pivoted in the clockwise direction about axis 218 from the position shown in FIG. 12 and toward cam stop 194 to the position shown in FIG. 11, the cam face 212 moves further away from clamping surface 193*a*, thereby reducing and eventually eliminating the pinching force or pressure being applied to the strap end. Likewise, when the friction cam is pivoted in the counterclockwise direction about axis 218 from the position shown in FIG. 11 to the position shown in FIG. 12, cam face 212 is moved closer toward clamping surface 193*a***, thereby reducing the width of the gap therebetween.

In the operation of clasp assembly 190, strap end 126''' is threaded downwardly between the cam stop 194 and the exterior surface of toepiece 60''' and then through the gap defined by friction cam 196 and clamping surface **193*a* so that the strap end extends laterally outwardly from the clasp assembly as shown in FIG. 11. Free end 126''' is then pulled through the clasp assembly until the desired snugness of the toepiece 60''' over the instep of the skier's foot is achieved. It will be appreciated that as strap end 126''' is being pulled through the clasp assembly, the friction force acting between cam face 212 and the adjacent surface of the strap 86''' causes the cam 196 to pivot clockwise about axis 218 to rest against cam stop 194 which increases the gap between the cam face and the clamping surface 193*a* to permit the strap to readily slide through the gap. As can also be appreciated, as strap end 126''' is being so pulled, the strap end rides around the cam stop and, thus, does not bind or otherwise rub against the side of cam 196 thereby facilitating the ease with which the strap end slides through the clasp assembly 190**.

When the pulling force on the strap end 126''' (located outwardly of clasp assembly 190) is released, the tensile force on the strap 86''' naturally tends to cause the strap to retract backwardly through the clasp assembly; however, the friction force acting between cam face 212 and adjacent surface of strap 86''' rotates the cam in the counterclockwise direction relative to pivot axis 218 from the position of the cam shown in FIG. 11 to the position of the cam shown in FIG. 12. With this rotation of the cam, cam face 212 moves closer to the clamping surface **193*a* to tightly pinch strap 86''' between the cam face and the clamping surface, thereby to securely hold the strap against retraction. It will be appreciated that the tighter the strap 86''' is cinched, the larger the tensile load on the strap and, thus, the larger the torque load applied to the cam by the friction force acting between cam face 212 and the adjacent surface of the strap which proportionally increases the pinching or clamping force applied to the strap by the cam face and the clamping surface. As such, the level of the pinching or clamping force that is applied to strap 86''' is commensurate with the tightness to which strap 86'''** is cinched.

It may be desirable to increase the coefficient of friction between the cam face 212 and the adjacent surface of strap 86''' and/or the clamping surface and the opposite surface of strap 86''' thereby to enhance the ability of clasp assembly 190 to cinch the strap. As an illustrative, but not limiting example, this may be accomplished by knurling or otherwise "roughening" the cam face 212 and/or the clamping surface **193*a***.

After the strap 86''' has been tightened to the desired level, strap free end 126''' is simply threaded inwardly and upwardly through the gap 210 formed in cam 196, thereby to double the strap end back over on itself, as shown in FIG. 12, so that the strap end overlies the portion of strap 86''' which downwardly approaches the clasp assembly 190 from toepiece 160. When the strap free end portion 126'' is disposed in this "tucked" position, it conveniently overlies the sloped upper surface 214 of the cam section 206.

To loosen strap 86''' strap end 126''' manually pivoted, for instance with the fingers of the skier, in the clockwise direction about axis 218 to move the cam toward the cam stop 194. By this pivoting action, the distance between cam face 212 and clamping surface **193*a* is sufficiently increased thereby allowing strap 86''' through the clasp assembly 190. It will be appreciated that by the above construction of the clasp assembly 190, the tension of strap 86''' infinitely and automatically adjusted so that the desired snugness of toepiece 60''' above construction of clasp assembly 190 and by locating the clasp assembly upwardly above the top surface 14''' of ski 16'''** assembly is not detrimentally affected by sand or other debris which tend to collect at the binding. This has been a problem in water ski bindings constructed with a heelpiece which is longitudinally slidable within a track mounted on the top of a water ski. For instance, as employed in U.S. Pat. No. 3,089,158, noted above.

Figure 13:
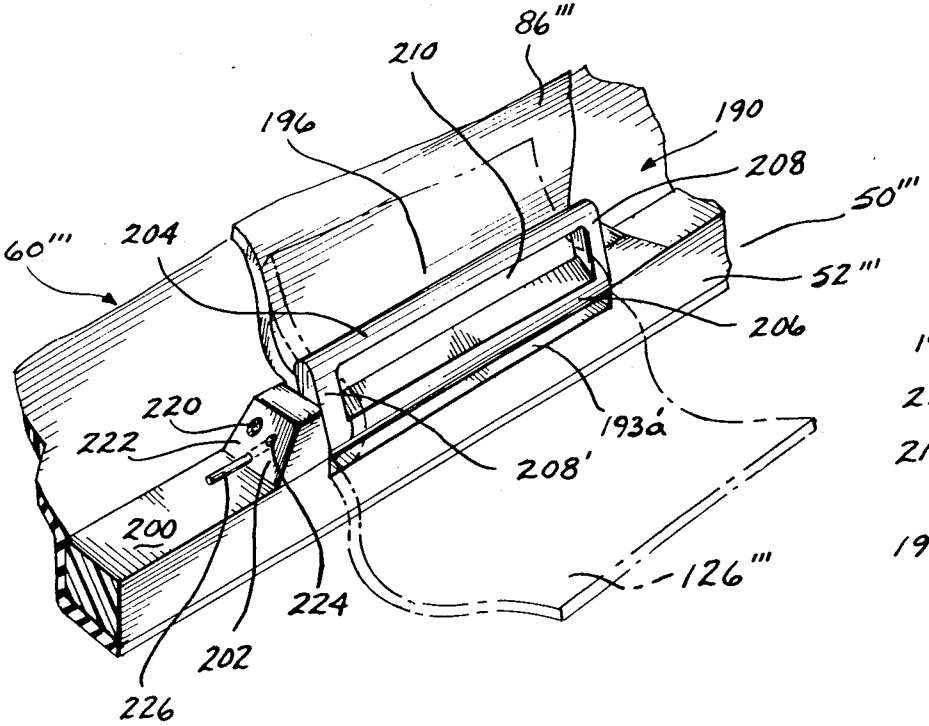
FIG. 13 is an enlarged, fragmentary, isometric view similar to FIG. 10 and illustrating a further preferred embodiment of the present invention.

FIG. 13 illustrates a clasp assembly 190' which is constructed and operates essentially in the same manner as clasp assembly 190, illustrated in FIGS. 10–12, but with the exception that a separate mounting bracket, such as mounting bracket 192, is not employed, but rather the bracket is integrally formed with external frame 50''''. In clasp assembly 190', appropriate aligned openings 220 are formed in shoulder 222 for reception of stop 194. Likewise, aligned openings 224 are formed in the shoulders 222 for reception of pivot pins 226, which correspond to pivot pins 216 of the clasp assembly 190 illustrated in FIGS. 10–12.

In accordance with another aspect of the present invention, as illustrated in FIGS. 11 and 12, a reinforcing strip 228 extends internally through the lower perimeter side portions 64''' of toepiece 60''', including side flanges 62''' and ridges 66'''. The reinforcing strip 228 has a wider major portion encased within the lower perimeter side portion 64''' and a narrower minor portion encased within side flanges 62''' and ridges 66', with the minor portion being angularly disposed relative to the major portion. It will be appreciated that strip 228 structurally reinforces this region of the binding toepiece 60''' so that when the binding is in use (with the toepiece clamped between external frame 50''' and the internal frame 34''') there is less likelihood that this region of the toepiece will tear or otherwise fail. The reinforcing strip preferably is constructed from a lightweight, flexible but high-strength material such as a metal or a suitable plastic. Also, preferably the reinforcing strip is integrally formed with the toepiece 60''', for instance, by placing the reinforcing strip into the mold used to form the toepiece, if the toepiece is formed by molding. It can be appreciated that a reinforcing strip similar to reinforcing strip 228 can be incorporated into the structure of the heelpiece 69 illustrated above in FIGS. 1 and 3 to provide similar structural reinforcement to the heelpiece.

Figure 14:
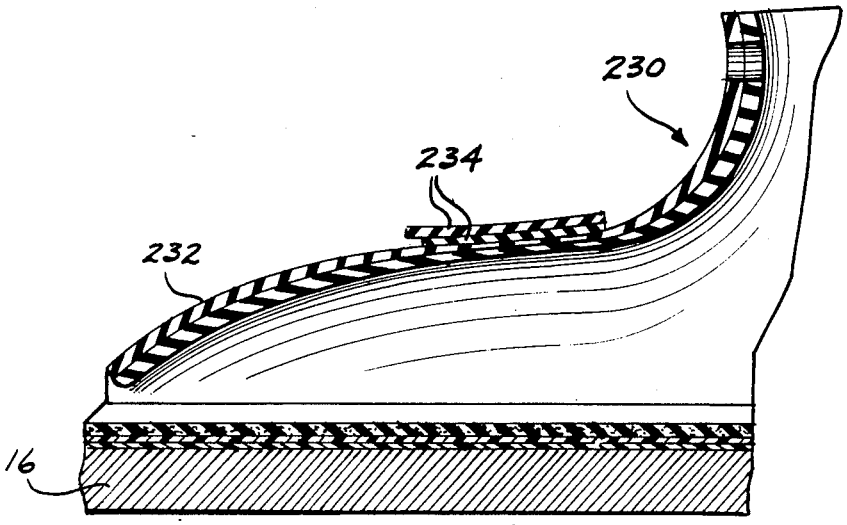
FIG. 14 is an enlarged, fragmentary, cross-sectional view illustrating an alternative preferred embodiment of the binding upper; and, FIG. 15 is an isometric view of the water ski binding similar to FIG. 1 and illustrating a further preferred embodiment of the binding upper.

FIG. 14 illustrates a further preferred embodiment of the present invention wherein an elastic binding upper 230 is constructed in the same manner as the binding upper 18 described above and illustrated in FIGS. 1, 3, 4, 6 and 7 with the exception that the top central portion of the roof area of toepiece 232, i.e., the region beneath straps 234, is formed in a thickness which is thinner than the remaining roof area of the toepiece. This allows the instep section, i.e., the section beneath straps 234, to readily expand and contract in relation to the size, and especially the width, of the skier's foot. Constructing the toepiece 232 in this manner improves the comfort of the binding upper without compromising the level of support provided by the binding upper since the skier's foot in the instep section of the toepiece 230 is restrained and supported by the overlying straps 234. The reduced thickness of the top central portion of the roof area of toepiece 232 may be in the range of $\frac{1}{4}$ to $\frac{3}{4}$ of the thickness of the remaining roof area of the toepiece and, ideally, approximately $\frac{1}{2}$ of the thickness of the general roof area of the toepiece. Thus, if the general roof area of the toepiece is constructed from an inner layer of, for instance, 0.25 inch 0.635 cm.) thick textured neoprene foam or similar material, the inner layer at the top central portion of the roof area may be reduced to a thickness of approximately 0.125 inch (0.318 cm.) thick. Similarly, if the outer layer of the roof area of the toepiece is formed from, for instance, 0.125 inch (0.3175 cm.) to 0.375 inch (0.925 cm.) thick neoprene or similar material, then likewise the top central portion of the roof area may be formed from a thickness of from about 0.0625 inch (0.1588 cm.) to 0.188 inch (0.462 cm.) thick neoprene or similar material.

Figure 15:
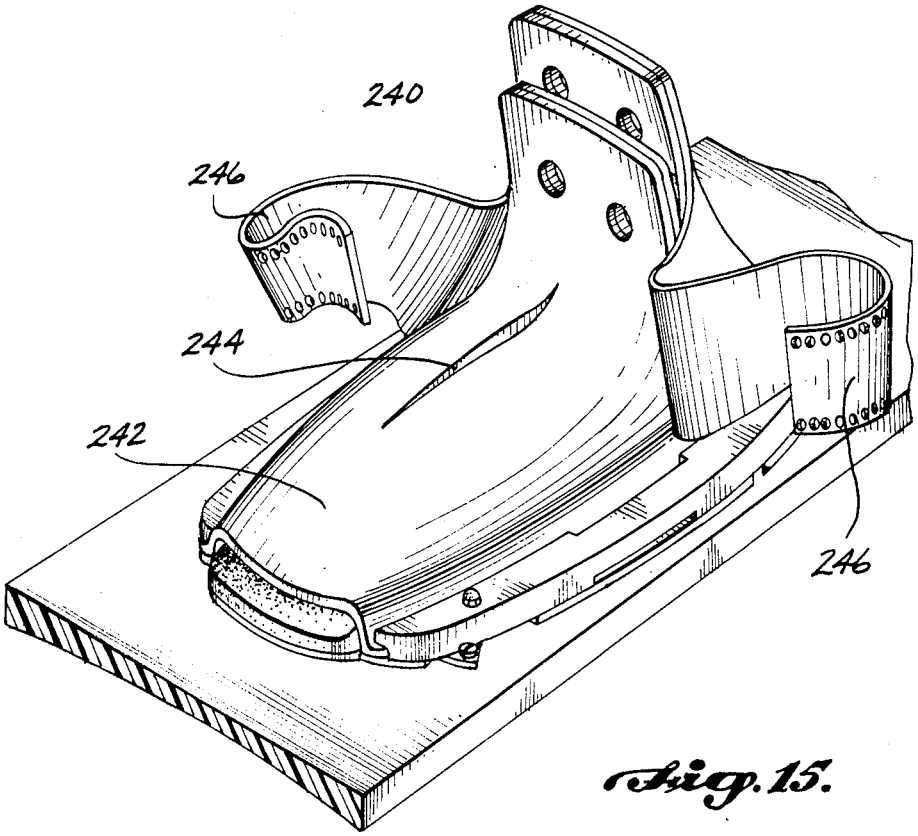

FIG. 15 illustrates a further preferred embodiment of the present invention. The water ski binding 240 illustrated in FIG. 15 is constructed substantially identically with binding 10, shown in FIGS. 1–4, 6 and 7, with the exception of the construction of toepiece 242. Toepiece 242 is constructed the same as toepiece 60 of binding 10 but with the exception of the addition of an elongate slit 244 extending longitudinally along the top central instep portion of the roof area of the toepiece, i.e., the region of the toepiece underlying the locations at which straps 246 cross the toepiece. As will be appreciated, slit 244 enables the toepiece to readily expand and contract in width across the instep of the skier's foot to accommodate feet of various sizes and widths, thereby increasing the comfort of binding 240. Because the instep portion of a skier's foot is supported and restrained by the crisscrossing straps 246, slit 244 does not reduce or otherwise detrimentally affect the support provided to the skier's foot by binding 240 while having the advantage of providing optimum fit and comfort for the feet of a large number of skiers.

There have been described preferred embodiments of the water ski binding having a laterally supportive abutment ridge, an adjustable width, and a method for varying the binding cavity size. It will be appreciated by those skilled in the art of the present invention that the teachings of this invention may be used to advantage in any situation where it is desirable to provide a water ski binding having maximum support for the skier's foot and ankle, while maintaining some adjustability. Therefore, it is to be understood by those skilled in the art that various changes, additions, and omission may be made in the form and the detail of the description of the present invention set forth above without departing from the spirit or essential characteristics thereof. The particular embodiments of the water ski bindings, described above, are therefore to be considered in all respects as illustrative and not restrictive, i.e., the scope of the present invention is set forth in the appended claims, rather than being limited to the examples of water ski bindings set forth in the foregoing description.

The embodiments of the invention in which an exclusive property or privilege is claimed are defined as follows:

1. A water ski binding comprising:

(a) a binding upper having:

a toe piece and a heel piece cooperatively defining a binding cavity for receiving and restraining a foot, said toe and heel pieces having lower perimeter portions, said lower perimeter portions having upright sections forming the lower margins of the binding cavity; and, at least one strap extending forwardly from the heel piece and laterally across and down the side of the toe piece;

(b) a frame securable to the lower perimeter portions of the toe and heel pieces; and, (c) means for securing the strap of the heel piece to the frame at selected locations along the length of the strap thereby varying the size of the binding cavity defined by the binding upper, wherein said securing means comprise a clasp assembly for receiving the end portion of the strap of the binding upper and automatically cinching the strap at a desired location along the length of the strap.

2. A water ski binding according to claim 1, wherein said clasp assembly comprises:

(a) a clamping surface;

(b) a friction cam spaced from said clamping surface to define a strap receiving gap therebetween, said cam having a face disposed toward said clamping surface and against an adjacent portion of the strap; and, (c) pivot means for mounting the cam relative to said clamping surface with the cam face against an adjacent portion of the strap to cause the strap to pivot the cam face away from the clamping surface as the strap is pulled through the clasp assembly in the direction tending to tighten the binding upper and to pivot the cam face toward the clamping surface when the pull on the strap is terminated so that the strap initially begins to retract through the clasp assembly whereby the cam face pinches the adjacent portion of the strap against the clamping surface thereby preventing withdrawal of the strap relative to the clasp assembly and resulting in a residual tensile load on the strap.

3. A water ski binding according to claim 2, further comprising a cam stop disposed between said cam and said binding upper to limit the rotational movement of said cam and to guide said strap in its approach into the gap between the friction cam and the clamping surface as the strap is pulled through the clamp assembly.

4. A water ski binding according to claim 3, wherein said cam stop:

extends generally transversely to the length of the strap and generally longitudinally to the length of the binding alongside the binding upper; and, is located closely alongside the binding upper to retain the strap closely adjacent the lower side and perimeter portions of the binding upper.

5. A water ski binding according to claim 4, wherein the stop comprises an elongated bar extending substantially parallel to the rotational axis of said cam.

6. A water ski binding according to claim 3, further comprising a bracket for mounting the friction cam to the binding frame, said bracket having portions defining the clamping surface.

7. A water ski binding according to claim 6, wherein the bracket forms an integral portion of the binding frame.

8. A water ski binding according to claim 2, wherein said clasp assembly further comprises a mounting bracket for pivotally mounting clamping surface.

9. A water ski binding according to claim 8, wherein said mounting bracket having portions defining the clamping surface.

10. A water ski binding according to claim 9, wherein the mounting bracket is integrally formed as a portion of the binding frame.

11. A water ski binding comprising:

(a) a binding upper defining a binding cavity for receiving and restraining a foot, said binding upper having a lower perimeter portion and at least one strap extending laterally across the binding upper;

(b) a frame securable to the lower perimeter portion of the binding upper;

(c) means for securing the strap of the binding upper to the frame at selected locations along the length of the strap thereby varying the size of the binding cavity defined by the binding upper; and, (d) wherein said securing means comprise a clasp assembly for receiving the end portion of the strap of the binding upper and automatically cinching the strap at a desired location along the length of the strap, said clasp assembly comprises:

a clamping surface;

a friction cam spaced from said clamping surface to define a strap receiving gap therebetween, said cam having a face disposed toward said clamping surface and against an adjacent portion of the strap;

pivot means for mounting the cam relative to said clamping surface to permit the cam face to pivot away from the clamping surface as the strap is pulled through the clasp assembly in the direction tending to tighten the binding upper and allowing the cam face to pivot toward the clamping surface when the movement of the strap through the clasp assembly is terminated, whereby the cam face pinches the adjacent portion of the strap against the clamping surface thereby preventing withdrawal of the strap relative to the clasp assembly and resulting in a residual tensile load on the strap; and, a retainer spaced from and disposed in fixed relationship to said cam to cooperatively define a strap receiving loop with said cam for receiving a portion of said strap extending beyond the cam face and redirecting such free end portion of said strap back in the direction that said strap approaches said clasp assembly.

12. A water ski binding according to claim 11, wherein said retainer and said cam are constructed as an integral unit.

13. A water ski binding according to claim 1, wherein said clasp assembly comprising means for receiving and releasably clamping the strap at selected locations along the length of the strap.

14. The water ski binding according to claim 13, wherein said means for receiving and releasably clamping the strap comprises:

a clamping surface; and a cam rotatably mounted relative to the clamping surface to define a strap receiving gap between the clamping surface and the cam, said cam having a face disposed towards said clamping surface for clamping the strap between the clamping surface and the cam.

15. The water ski binding according to claim 1, wherein said clasp assembly is mounted on the binding frame.

16. The water ski binding according to claim 1, wherein said clasp assembly is in part integrated into the binding frame.

17. A water ski binding comprising:

(a) a binding upper defining a binding cavity for receiving and restraining a foot, said binding upper having a lower perimeter portion and at least one strap extending laterally across the binding upper;

(b) a frame securable to the lower perimeter portion of the binding upper;

(c) means for securing the strap of the binding upper to the frame at selected locations along the length of the strap thereby varying the size of the binding cavity defined by the binding upper; and, (d) wherein said binding upper includes an instep portion extending upwardly from the lower perimeter portion to extend over and cover the instep of a foot, said instep portion having a top central section which is more resilient than the remainder of the instep portion to readily expand and contract in the direction across the binding upper, wherein said instep portion includes a longitudinal slit extending along the top central section thereof.

* * * * *